US007547071B2

(12) United States Patent
Huffman

(10) Patent No.: US 7,547,071 B2
(45) Date of Patent: Jun. 16, 2009

(54) MATERNITY PILLOW

(76) Inventor: Felicity Huffman, 7095 Hollywood Dr., Los Angeles, CA (US) 90028

( * ) Notice: Subject to any disclaimer, the term of this patent is extended or adjusted under 35 U.S.C. 154(b) by 0 days.

(21) Appl. No.: 11/381,022

(22) Filed: May 1, 2006

(65) Prior Publication Data

US 2006/0279122 A1 Dec. 14, 2006

Related U.S. Application Data

(60) Provisional application No. 60/676,993, filed on May 2, 2005.

(51) Int. Cl.
*A47C 7/36* (2006.01)
*A47C 7/02* (2006.01)

(52) U.S. Cl. ..... 297/397; 297/393; 297/230.14; 297/230.13; 297/DIG. 6

(58) Field of Classification Search ..... 297/393, 297/397, 284.5, 230.1, 230.13, 230.14, 352, 297/391, 219.1, DIG. 6, 410; 5/636, 657.5, 5/925, 601, 606, 930, 652; D6/601, 606
See application file for complete search history.

(56) References Cited

U.S. PATENT DOCUMENTS

| | | | | | |
|---|---|---|---|---|---|
| 1,039,334 | A | * | 9/1912 | Trick | 4/575.1 |
| 2,566,757 | A | | 9/1951 | Alexander | 155/174 |
| 2,591,306 | A | * | 4/1952 | Sherman | 297/284.5 |
| 3,062,586 | A | * | 11/1962 | Rowland | 297/399 |
| 3,371,961 | A | | 3/1968 | Colgan | 297/397 |
| 3,387,886 | A | | 6/1968 | Longo et al. | 297/397 |
| 3,578,383 | A | | 5/1971 | Earl | 297/391 |
| 3,689,947 | A | | 9/1972 | Wolf | 5/344 |
| 5,042,278 | A | | 8/1977 | Jenson | 297/397 |
| 4,206,945 | A | * | 6/1980 | Kifferstein | 297/220 |
| 4,738,488 | A | | 4/1988 | Camelio | 297/393 |
| 4,754,511 | A | * | 7/1988 | Sargent | 5/655.4 |
| 4,877,288 | A | | 10/1989 | Lee | 297/229 |
| D315,076 | S | | 3/1991 | Hanna | D6/601 |
| 5,008,960 | A | | 4/1991 | Hemming | 2/104 |
| D317,541 | S | * | 6/1991 | Carwile | D6/601 |
| D318,772 | S | | 8/1991 | Phillips | D6/595 |
| D338,587 | S | | 8/1993 | Harnish | D6/601 |

(Continued)

FOREIGN PATENT DOCUMENTS

| | | |
|---|---|---|
| GB | 767641 | 2/1957 |

(Continued)

OTHER PUBLICATIONS

International Search Report- Aug. 17, 2007.

*Primary Examiner*—Milton Nelson, Jr.
(74) *Attorney, Agent, or Firm*—Sofer & Haroun, LLP

(57) ABSTRACT

A support apparatus for use with a seat that supports the user's head, neck, or back, and provides an area for the user to rest an infant while nursing. The support apparatus is used with a backrest of a seat having an upper end, a rear face and a front face. The support apparatus has a pillow body with first and second sides and an outer circumference between them, a skirt portion with a first end attached to the outer circumference of the cylindrical pillow body and a second free end, and a friction portion located on the skirt portion that prevents the pillow body from sliding down the front face of the seat.

14 Claims, 5 Drawing Sheets

U.S. PATENT DOCUMENTS

| | | | | | |
|---|---|---|---|---|---|
| 5,345,633 | A | | 9/1994 | Harnish | 5/639 |
| 5,361,435 | A | | 11/1994 | Reeves | 5/419 |
| 5,545,199 | A | | 8/1996 | Hudson | 607/109 |
| 5,551,752 | A | * | 9/1996 | Lovegrove et al. | 297/284.5 |
| 5,567,015 | A | | 10/1996 | Arias | 297/397 |
| D383,027 | S | | 9/1997 | Ridell | D6/601 |
| 5,740,567 | A | * | 4/1998 | Mitchell | 5/420 |
| D400,042 | S | | 10/1998 | Black, Jr. | D6/610 |
| 5,836,653 | A | | 11/1998 | Albecker | 297/452.31 |
| 5,906,878 | A | * | 5/1999 | Horning et al. | 428/131 |
| 6,030,034 | A | | 2/2000 | Plohetski | 297/188.06 |
| 6,116,691 | A | | 9/2000 | Reece | 297/392 |
| 6,182,309 | B1 | | 2/2001 | Sullivan | 5/519 |
| 6,216,298 | B1 | * | 4/2001 | Oliveira | 5/636 |
| 6,254,189 | B1 | | 7/2001 | Closson | 297/397 |
| 6,484,335 | B2 | | 11/2002 | Gilbert | 5/636 |
| 6,691,352 | B2 | | 2/2004 | Wang | 5/636 |
| 6,748,615 | B1 | | 6/2004 | Tiedemann | 5/640 |
| 6,782,572 | B1 | | 8/2004 | Jones | 5/640 |
| 7,207,627 | B2 | * | 4/2007 | Jerome | 297/219.1 |
| 2002/0067063 | A1 | | 6/2002 | Taborro | 297/397 |
| 2004/0026966 | A1 | | 2/2004 | Alberson | 297/188.06 |

FOREIGN PATENT DOCUMENTS

| | | | | |
|---|---|---|---|---|
| GB | 2274582 | A | * | 8/1994 |

* cited by examiner

MATERNITY PILLOW

RELATED APPLICATION

This application is related to and claims the benefit of priority from U.S. Provisional Patent Application No. 60/676,993, filed on May 2, 2005, the entirety of which is incorporated herein by reference.

FIELD OF THE INVENTION

The present invention relates generally to the field of head and back support cushion devices for seats, and more particularly, to a head or back support cushion.

BACKGROUND OF THE INVENTION

Cushion devices for chairs or other seats are typically used to provide head, neck, or back support for a user. People often place cushions on the backrest of a seat in order to give them added support and comfort as they sit in either an upright or inclined position. The angle of incline of the seat and the specific preferences or needs of the user dictate the location on the backrest of the seat at which the user desires the cushion to be placed. One problem that often arises with seat cushions is that their positioning on the backrest of the seat changes as the user moves in the chair or leans forward, allowing gravity to pull the cushion in a downward direction. A number of devices in the prior art utilize a variety of fastening arrangements that fix cushions in place by connecting them to the seat. However, these attachments make vertical and lateral adjustment of the cushion, as well as its removal from the seat, more complicated.

U.S. Pat. No. 3,387,886 shows a headrest mounted on a pair of brackets made of spring steel and forming a 'V' shape enclosure. The device snaps over the uppermost portion of an automobile seat. As wing nuts on the device are tightened, the resulting increased spring tension against the seat locks the headrest assembly in place.

U.S. Pat. No. 4,738,488 shows an adjustable headrest with an elongated tab with a fastener to hang the adjustable headrest from the back of a seat or to hold the headrest in a doubled-over position to function as a neck support. The device contains a "U shaped" bolster or pillow with an elongated tab containing VELCRO™ brand connection strips and is fastened to a flexible fabric panel.

U.S. Pat. No. 5,567,015 shows an inflatable headrest device with two cushions attached to a sheet member with a mechanism for securing the apparatus to the back of a chair. The device contains a flexible sheet member, a pair of lateral head support cushions, and belts and straps to secure the device to the seat.

U.S. Pat. No. 6,030,034 shows a storage bag and chair cover that can act as a pillow. This device contains VELCRO™ brand connection straps that attach the device to the chair.

U.S. Pat. No. 6,254,189 shows a body support device that allows the user to modify the density of specific parts of the device by redistributing filler material in the device through a continuous hollow chamber. The device contains a hollow housing member that has a hollow neck portion and bulbous housing elements on opposite sides of the hollow neck portion which combine to form a continuous hollow chamber. The hollow chamber is partially filled with filler material that can be redistributed throughout the hollow chamber to vary the firmness and density of the bulbous housing elements.

U.S. Pat. No. 6,484,335 shows a pillow unit containing a pillow, a pocket assembly, and straps connecting the pillow to the back of a seat.

U.S. Pat. No. 6,748,615 shows a neck supporting cushion containing a securing unit that has elongated adjustable straps with cooperating fasteners on opposite ends, a pillow unit that contains a pillow member and a cylindrically shaped fabric envelope filled with foam beads or other particulate material, and a removable cover unit that has a cylindrically shaped fabric cover with end panels dimensioned to slidably receive the elongated strap member and hidden elongated zipper portion.

U.S. Design No. 400,042 shows an ornamental design for a headrest cover.

Thus, while the foregoing body of prior art reveals numerous portable pillows or cushions that can be attached to the backs of chairs, there is a need for a neck or back support device that can be manufactured inexpensively and can be used easily, without the need for various attachment mechanisms.

BRIEF SUMMARY OF THE INVENTION

The present invention in accordance with one embodiment contains a cushion device, for example, in the shape of a cylindrical pillow body having an elongated skirt portion with an inner side and an outer side attaching at one end to the outer circumference of the cylindrical pillow body. In accordance with another embodiment of the invention, the cylindrical pillow body has a tapered portion in the middle. Furthermore, in yet another embodiment, the inner side of the skirt portion includes a friction portion having a high coefficient of static friction.

The cushion device, when configured with the skirt extending over the front face, upper end, and rear face of the backrest of a seat, fixes the cylindrical pillow body at any desired height against the backrest of the seat. The inner side of the skirt portion holds the cylindrical pillow body at the specified height and prevents it from moving. As neither the skirt portion nor the cylindrical pillow body attaches to the seat, the cushion device is easily adjustable and removable. If the user places the cylindrical pillow body at head level, then the exemplary tapered portion provides lateral support.

This device can be easily stored, for example, under a seat because the skirt portion wraps around the cylindrical pillow, and the tapered portion allows the device to be folded in half.

BRIEF DESCRIPTION OF THE FIGURES

Various other objects, advantages and features of the invention will become apparent to those skilled in the art from the following discussion taken in conjunction with the following drawings, in which.

Reference is now made to the drawings, wherein like characteristics and features of the present invention shown in the various FIGS. are designated by the same reference numerals.

DETAILED DESCRIPTION

Figure 1:
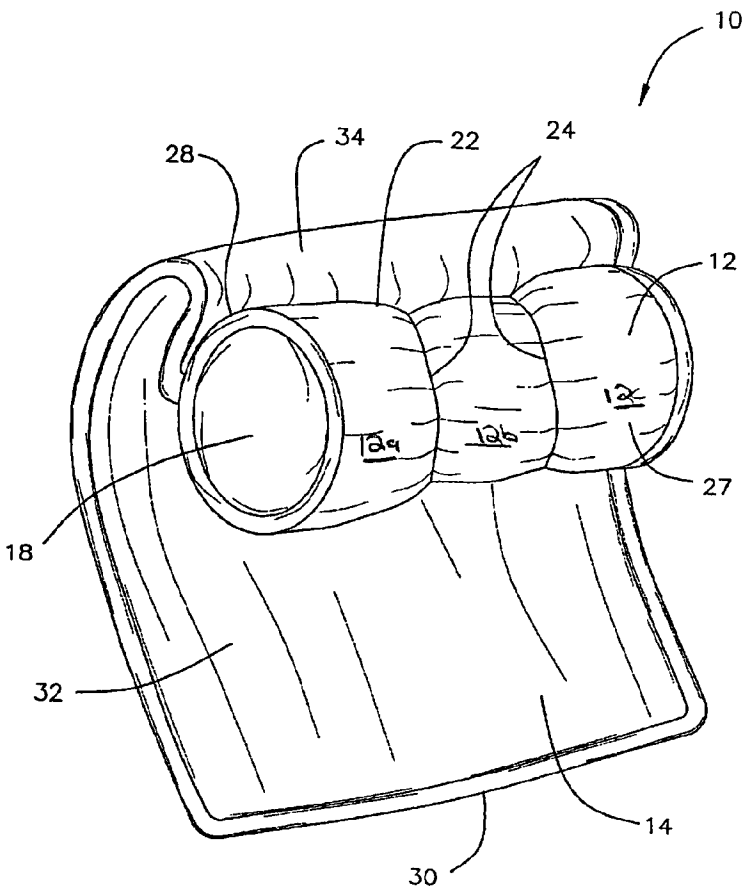
FIG. 1 is a representation of the front perspective view of the pillow embodying various features of the present invention.
Figure 2:
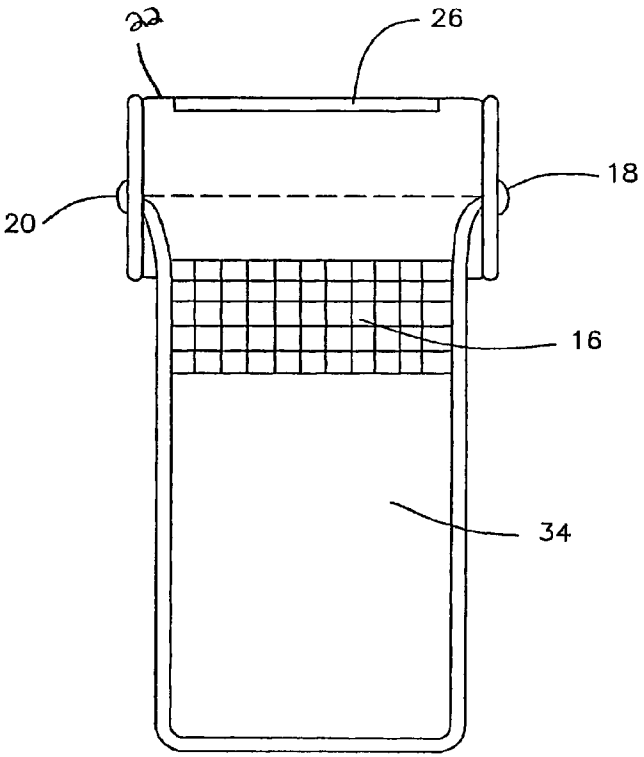
FIG. 2 is a rear view of the pillow as shown in FIG. 1.

Referring to FIGS. 1 and 2, a support apparatus 10 in accordance with one embodiment of the invention is disclosed, having a cylindrical pillow body 12, a skirt portion 14, and a friction portion 16, although the invention is not limited in scope in that respect. For example, pillow body can be in any desired shape suitable to provide back or neck support.

Cylindrical pillow body 12 has a first side 18, a second side 20, an outer circumference 22 between the first side 18 and the second side 20, a tapered portion 24 in the middle of it and a zipper 26 on the outer circumference 22 running along a substantially horizontal axis. The interior of cylindrical pillow body 12 contains a removable pillow cushion 27 having substantially the same shape as the pillow body itself. In one embodiment of the invention, the cylindrical pillow body includes two side sections 12*a* and 12*c* and a middle section 12*b* having a diameter smaller than the adjoining side sections so as to form the taper portion 24. However, as mentioned previously, the invention is not limited in scope in that respect and other forms and shapes of pillows are contemplated within the context of the present invention.

Skirt portion 14 has a first end 28 attached to the outer circumference 22 of cylindrical pillow body 12 along a substantially horizontal axis, a second free end 30, an inner side 32, and an outer side 34. Friction portion 16, is defined within the inner side 32 of skirt portion 14 in a desired shape, such as a rectangular shape as shown in FIG. 2. However, this depiction of the friction portion 16 is not intended to limit the scope of the present invention. For example, it is understood that friction portion 16 could be located anywhere on the inner side 32 of skirt portion 14. Furthermore, friction portion 16 in accordance with one embodiment is integrated within skirt portion 14. In the alternative, and in accordance with another embodiment of the invention, friction portion 16 is attached on inner side 32 of the skirt portion. Yet in accordance with another embodiment of the invention, friction portion 16 is removably attached on a desired location along the length of inner side 32, for example via a VELCRO™ brand connection arrangement. In accordance with another embodiment of the invention, the entire surface of inner side 32 is made of a material with a high coefficient of friction, in such a way that when apparatus 10 is resting on a structure, such as the back of the chair, the friction is sufficient to prevent the apparatus from sliding undesirably.

Figure 3:
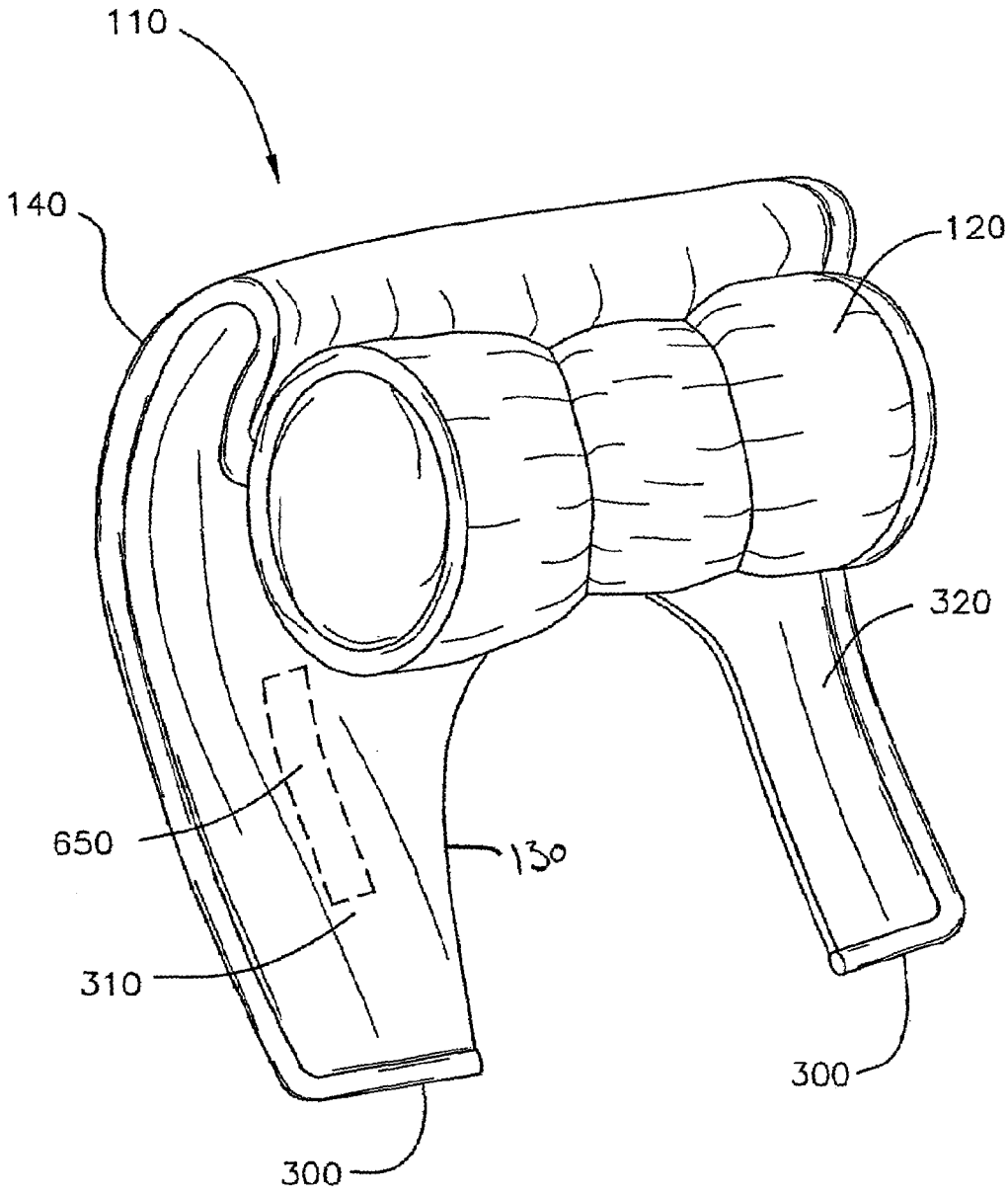
FIG. 3 is the embodiment of FIG. 1 with a notch cut out of the skirt portion of the pillow.

Referring to FIG. 3, a support apparatus 110 is shown as another embodiment of the present invention. Support apparatus 110 has a cylindrical pillow body 120, a skirt portion 140, and a neckline 130 defining a neck opening 160. Support apparatus 110 includes cylindrical pillow body 120 attached to skirt portion 140. Neckline 130 defines a left shoulder flap 310 and a right shoulder flap 320.

Figure 4:
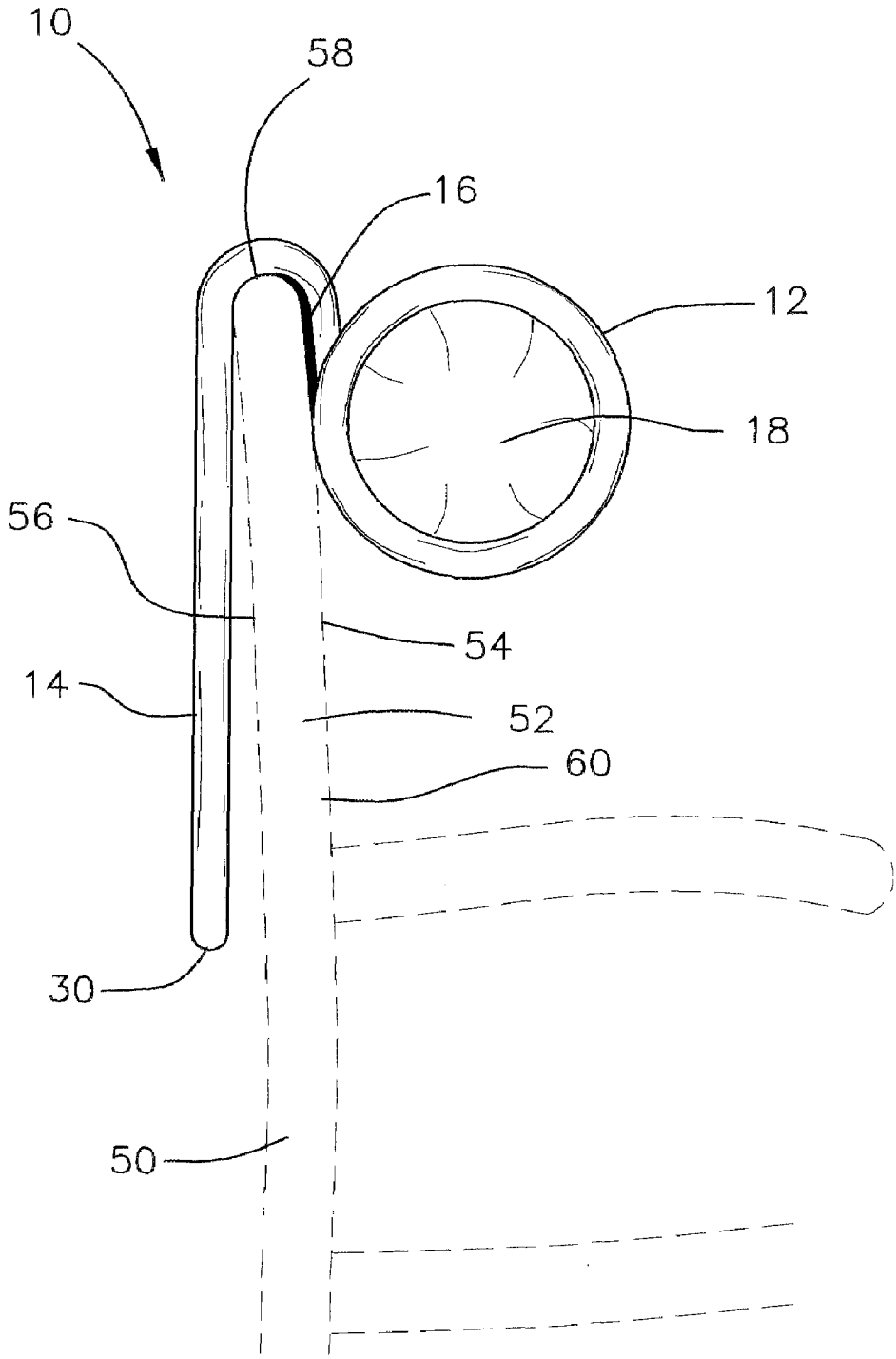
FIG. 4 is a side view of the pillow as shown in FIG. 1.

An exemplary use of apparatus 10 in accordance with one embodiment of the invention is further explained in reference with FIG. 4. Support apparatus 10 of FIG. 1 is shown draped over a seat 50. Seat 50 has a backrest 52 with a front face 54, a rear face 56, an upper end 58, and a lower end 60. Friction portion 16, made of corrugated rubber or other material having a high coefficient of static friction, is placed against front face 54 of seat 50 at upper end 58.

Friction portion 16 prevents cylindrical pillow body 12 from sliding. In addition, the weight of skirt portion 14, hanging over the backrest 52 helps prevent cylindrical pillow body 12 from sliding in a downward direction. Cylindrical pillow body 12 can be placed at any desired point along front face 54 of seat 50, but would most often be utilized at the upper end 58, to support the user's head or neck, or at the lower end 60, to support the user's lower back. The support apparatus 10 is especially useful for a woman nursing an infant It may also be draped over a car seat or the headboard of a bed.

The tapered portion 24 (see FIG. 1) of the cylindrical pillow body 12 provides both lateral and vertical support to a user's head or neck. The height of cylindrical pillow body 12 along front face 54 of backrest 52 of seat 50 can be easily adjusted by moving the cylindrical pillow body 12 to the desired location, and keeping skirt portion 14 over backrest 52 of the seat 50. Support apparatus 10 does not require any attachments fixing it to seat 50, regardless of the height along backrest 52 at which cylindrical pillow body 12 is placed. Zipper 26 (see FIG. 2) on cylindrical pillow body 12 allows pillow cushion 27 to be taken out, cleaned, and replaced.

Figure 5:
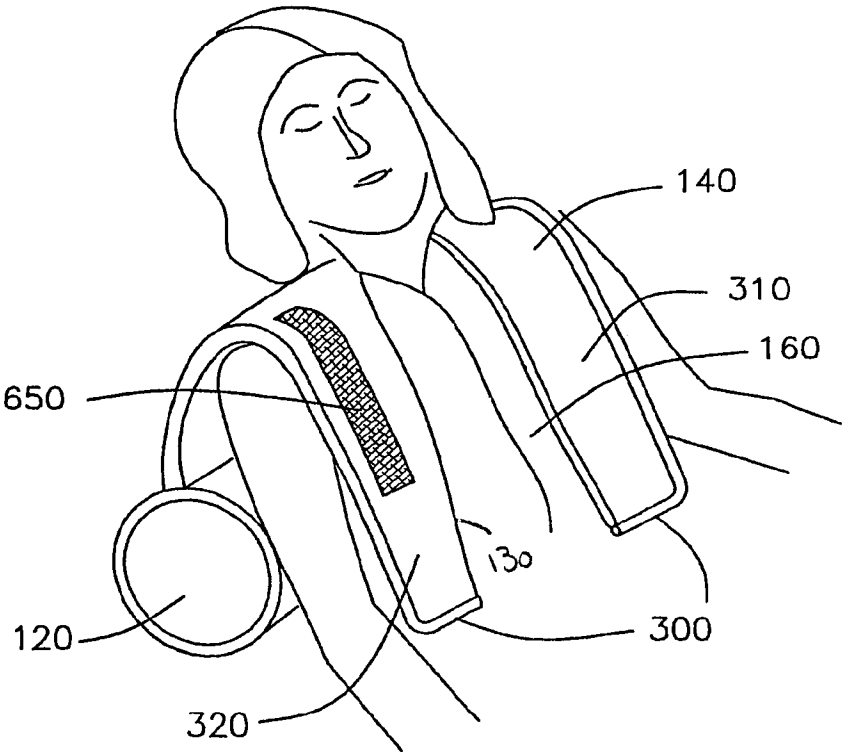
FIG. 5 is a rear perspective view of FIG. 3 with a bib placed on the skirt portion of the pillow next to the notch.

An exemplary use of apparatus 110 in accordance with one embodiment of the present invention is described in reference with FIG. 5. Accordingly, support apparatus 110 of FIG. 3 is shown with shoulder flaps 310 and 320 positioned to be draped over a user's shoulders, for example, while the user sits on a seat In this configuration, cylindrical pillow body 120 is pressed between the front face of the backrest of the seat and the user's neck or back. Left shoulder flap 310 of the skirt portion 140 rests over the user's left shoulder and right shoulder flap 320 rests over the user's right shoulder. A bib may be attached to the right flap 320 of the skirt portion 140, for example, via a VELCRO™ brand connection attachment 650.

A user by moving the shoulder flaps up and down can easily adjust the position of cylindrical pillow 120 within the neck or back area. The user can then lean back in the seat. This configuration will provide support to the users head, neck, or back and provide a place to put a napkin or bib while feeding a baby. This arrangement allows the user to use the support device with public seats, such as for example on airplane seats, without the need to rest the skirt portion on the back rest of the airplane seat. In accordance with one embodiment of the invention, the side of skirt portion 140 that rests on the user's back is made of a material having a sufficiently high friction coefficient, so as to avoid sliding along the user's back. As such, pillow body 120 remains in the same desired position along the user's back, even when the user is not leaning against the back rest, until such time that the user readjusts its position.

While the invention has been described and shown in various terms and certain embodiments, the scope of the invention is not intended to be, nor should it be deemed to be, limited thereby and such other modification or embodiments as may be suggested by the teachings herein are particularly reserved especially as they fall within the breadth and scope of the claims here appended.

The invention claimed is:

1. A support apparatus for use with a seat having a backrest, said backrest having an upper end, a rear face and a front face, said support apparatus comprising:

a cylindrical pillow body having first and second sides and an outer circumference between said first and second sides;

a skirt extending from a substantially horizontal axis along the surface of said cylindrical pillow body at a first end and further having a second free end, said free end of said skirt includes an opening defining a right shoulder flap extension and a left shoulder flap extension, said skirt having inner and outer sides, said inner side for contacting a portion of the rear face and the front face of the backrest; and a friction portion located on said inner side of said skirt so that when said cylindrical pillow body is placed at said upper end of the backrest and said skirt is draped over the backrest, said friction portion allows said cylindrical pillow body to be positioned at any height on the backrest of the seat and prevents said cylindrical pillow body from sliding down the front face of the backrest.

2. The support apparatus of claim 1, wherein said cylindrical pillow body is tapered such that the diameter of first and second lateral sides of said cylindrical pillow body is greater than the diameter of a middle section of said cylindrical pillow body.

3. The support apparatus of claim 1, wherein said cylindrical pillow body further comprises a zipper mounted along a horizontal axis to allow the removal of a pillow fill material.

4. The support apparatus of claim 1, wherein said cylindrical pillow body and said skirt portion are made of a fabric material.

5. The support apparatus of claim 1, wherein said friction portion is made out of a rubber material.

6. The support apparatus of claim 1, wherein said friction portion is secured to said skirt at said first end.

7. The support apparatus of claim 1, wherein said friction portion is secured to said skirt at said free end.

8. A support apparatus for use with a seat having a backrest, said backrest having an upper end, a rear face and a front face, said support apparatus comprising:

a cylindrical pillow body having a fiberfill interior, said cylindrical pillow body fabricated from a cloth material and having first and second sides and an outer circumference between said first and second sides;

a skirt fabricated from a cloth material, extending from a substantially horizontal axis along the surface of said cylindrical pillow body at a first end and a second free end, said free end of said skirt includes an opening defining a right shoulder flap extension and a left shoulder flap extension, said skirt having inner and outer sides, said inner side for contacting a portion of the rear face and the front face of the backrest; and at least one side of said skirt having a friction portion so that when said cylindrical pillow body is placed at said upper end of the backrest and said skirt is draped over the backrest, said friction portion allows said cylindrical pillow body to be positioned at any height on the backrest of the seat and prevents said cylindrical pillow body from sliding down the front face of the backrest.

9. The support apparatus of claim 8, wherein said friction portion is secured to said skirt at said free end.

10. The support apparatus of claim 8, wherein said at least one side of said skirt is made of a friction material.

11. The support apparatus of claim 8, wherein said friction portion is made of rubber.

12. The support apparatus of claim 8, wherein said outer circumference of said cylindrical pillow body is tapered such that the diameter of first and second lateral sides of said cylindrical pillow body is greater than the diameter of a middle section of said cylindrical pillow body.

13. The support apparatus of claim 12, wherein said cylindrical pillow body further comprises a zipper mounted along a horizontal axis to allow the removal of a pillow fill material.

14. The support apparatus of claim 8, wherein said friction portion is secured to said skirt at said first end.

* * * * *